US008881693B2

(12) United States Patent
Hayashi et al.

(10) Patent No.: US 8,881,693 B2
(45) Date of Patent: Nov. 11, 2014

(54) COOLING SYSTEM OF ENGINE

(75) Inventors: Kunihiko Hayashi, Odawara (JP); Syusaku Sugamoto, Susono (JP); Yoshio Hasegawa, Susono (JP); Hirokazu Hata, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/389,994

(22) PCT Filed: Mar. 18, 2011

(86) PCT No.: PCT/JP2011/056532

§ 371 (c)(1),
(2), (4) Date: Feb. 10, 2012

(87) PCT Pub. No.: WO2012/127555

PCT Pub. Date: Sep. 27, 2012

(65) Prior Publication Data

US 2014/0007824 A1 Jan. 9, 2014

(51) Int. Cl.

| | |
|---|---|
| ***F01P 9/00*** | (2006.01) |
| ***F01P 3/00*** | (2006.01) |
| ***F01P 7/16*** | (2006.01) |
| *F01P 3/20* | (2006.01) |
| *F01P 11/04* | (2006.01) |
| *F01P 11/06* | (2006.01) |

(52) U.S. Cl.

CPC . *F01P 3/00* (2013.01); *F01P 7/167* (2013.01); *F01P 3/20* (2013.01); *F01P 11/04* (2013.01); *F01P 2060/08* (2013.01); *F01P 11/06* (2013.01); *F01P 2207/146* (2013.01)

USPC ..... 123/41.01

(58) Field of Classification Search

CPC ..... F01P 3/20; F01P 11/04; F01P 11/06; F01P 2007/146; F01P 2060/08

USPC ..... 123/41.01

See application file for complete search history.

(56) References Cited

U.S. PATENT DOCUMENTS 5,701,852 A 12/1997 Suzuki et al.
6,371,060 B1 4/2002 Lehmann et al.

(Continued)

FOREIGN PATENT DOCUMENTS

DE 196 35 044 A1 3/1997
DE 102 07 653 C1 9/2003

(Continued)

OTHER PUBLICATIONS

International Search Report issued in International Application No. PCT/JP2011/056532 dated Jun. 21, 2011 (with translation).

*Primary Examiner* — Lindsay Low
*Assistant Examiner* — Charles Brauch
(74) *Attorney, Agent, or Firm* — Oliff PLC

(57) ABSTRACT

A cooling system is incorporated into an engine cooling circuit including a pump for circulating a coolant of an engine and a radiator for cooling the coolant of the engine. The cooling system includes a first passage portion provided between the engine and a coolant outlet of the pump; a second passage portion provided between the engine and an coolant inlet of the pump, a rotary valve disc interposed in the passage portions and being rotatable so as to simultaneously control the coolant flowing through the first passage portion and the coolant flowing through the second passage portion.

6 Claims, 10 Drawing Sheets

(56) References Cited

U.S. PATENT DOCUMENTS

| | | | | |
|---|---|---|---|---|
| 7,886,988 | B2 * | 2/2011 | Schwartz et al. | 237/12.3 R |
| 2004/0237912 | A1 | 12/2004 | Pawellek et al. | |
| 2005/0001044 | A1 | 1/2005 | Masuko et al. | |
| 2005/0034688 | A1 * | 2/2005 | Lelkes et al. | 123/41.01 |
| 2006/0157002 | A1 | 7/2006 | Pfeffinger et al. | |
| 2009/0139686 | A1 | 6/2009 | Suzuki | |
| 2009/0223657 | A1 * | 9/2009 | Hollis | 165/287 |
| 2010/0282190 | A1 * | 11/2010 | Stoermer | 123/41.08 |
| 2012/0055652 | A1 | 3/2012 | Triebe et al. | |

FOREIGN PATENT DOCUMENTS

| | | | |
|---|---|---|---|
| JP | A-01-253524 | | 10/1989 |
| JP | A-10-077837 | | 3/1998 |
| JP | A-2001-041039 | | 2/2001 |
| JP | A-2002-138835 | | 5/2002 |
| JP | A-2003-239737 | | 8/2003 |
| JP | A-2004-100479 | | 4/2004 |
| JP | A-2004-324445 | | 11/2004 |
| JP | A-2005-083239 | | 3/2005 |
| JP | A-2005-510668 | | 4/2005 |
| JP | A-2006-528297 | | 12/2006 |
| JP | A-2007-120312 | | 5/2007 |
| JP | A-2010-053732 | | 3/2010 |
| WO | WO 03/046342 | A1 | 6/2003 |
| WO | WO 2010/127825 | A2 | 11/2010 |

* cited by examiner

COOLING SYSTEM OF ENGINE

TECHNICAL FIELD

The present invention relates to a cooling system of an engine.

BACKGROUND ART

For example, Patent Documents 1 to 5 disclose techniques, as a technique for controlling engine coolant flow, which may be relevant to the present invention.

Patent document 1 discloses a water pump, of an internal combustion engine, equipped with a rotary valve changing injection outlets. Patent document 2 discloses a cooling apparatus of the engine equipped with a high temperature thermostat valve and a low temperature thermostat valve. Patent document 3 discloses an automotive coolant control valve controlling the coolant distribution and the coolant flow, instead of the thermostat of a radiator and a valve of a heater. Patent document 4 discloses an automotive internal combustion engine equipped with: a first control unit feeding the coolant into a cylinder head and/or a crank case; and a main coolant pump turned on or off. Patent document 5 discloses two systems of the cooling apparatus thermostat capable of for controlling two coolant paths independently.

PRIOR ART DOCUMENT

Patent Document

[Patent Document 1] Japanese Patent Application Publication No. 10-77837

[Patent Document 2] Japanese Patent Application Publication No. 1-253524

[Patent Document 3] Japanese National Publication of International Patent Application No. 2005-510668

[Patent Document 4] Japanese National Publication of International Patent Application No. 2006-528297

[Patent Document 5] Japanese Patent Application Publication No. 2004-100479

SUMMARY OF THE INVENTION

Problems to be Solved by the Invention

In a case where the coolant flows through the engine, the coolant flow is generally controlled between a path passing through the radiator and a path bypassing the radiator, at an inlet side of the pump circulating the coolant. Also, the coolant flow is controlled at an outlet side of the pump, for example, in order to adjust a flow rate of the supply coolant or to control the coolant flow between plural flow paths.

In this regard, in order to control the coolant flow, a cooling circuit may be configured to individually combine various configuration as needed. However, this case complicates the cooling circuit. As a result, there may be disadvantage in cost, and there may be deterioration in installing performance to a vehicle. Also, in the case where the coolant flows through the engine, the coolant flow control demands high reliability. This is because the engine may be overheated in some cases unless the flow is certainly controlled.

The present invention has been made in view of the above circumstances and has an object to provide a cooling system of an engine, thereby controlling the coolant flow with high reliability while simplifying a coolant circuit, in a case of flowing the coolant through the engine.

Means for Solving the Problems

The present invention is an engine cooling system incorporated into an engine cooling circuit comprising a pump for circulating a coolant of an engine and a radiator for cooling the coolant of the engine, the engine cooling system including: a first passage portion through which the coolant of the engine flows, and which is provided between the engine and an coolant outlet of the pump; a second passage portion through which the coolant of the engine flows, and which is provided between the engine and an coolant inlet of the pump; and a rotary valve disc interposed in the first and second passage portions, and being rotatable so as to simultaneously control the coolant flowing through the first passage portion and the coolant flowing through the second passage portion.

The present invention may further includes: a rotary valve comprising the first and second passage portions and the rotary valve disc, and being an electric motor driven type; and a control portion controlling the rotary valve.

In the present invention, the first passage portion may branch off to an engine bypass path bypassing the engine at an upstream side of the rotary valve disc, and the rotary valve may cause the coolant to flow through the engine bypass path, when the rotary valve disc portion restricts the coolant from flowing through the first passage portion.

In the present invention, the first passage may branch off to a cylinder block and a cylinder head of the engine at a downstream of the rotary valve disc, and the rotary valve disc portion may restrict the coolant from flowing through the first passage portion to the cylinder block and may release restriction of the coolant flowing to the cylinder head such that the rotary valve causes the coolant to preferentially flow to the cylinder head, selected from the cylinder block and the cylinder head.

In the present invention, the second passage portion may communicate with the radiator at an upstream side of the rotary valve disc, and the rotary valve disc may restrict a flow rate of the coolant flowing through the second passage from an upstream side to a downstream side of the rotary valve disc such that the rotary valve restricts a flow rate of the coolant flowing through the radiator.

In the present invention, the rotary valve may further includes a first thermostat that opens when a temperature of the coolant of the engine is higher a first predetermined value, the second passage portion may communicate with the radiator through the first thermostat at the downstream side of the rotary valve disc, and the control portion may control the rotary valve to restrict the flow rate of the coolant flowing through the second passage portion from the upstream side to the downstream side of the rotary valve disc, when the temperature of the coolant of the engine is significantly lower than the first predetermined value.

In the present invention, the rotary valve may further includes a second thermostat that opens when the temperature of the coolant of the engine is higher than a second predetermined valve, the second passage portion may communicate with the radiator through the second thermostat at the upstream side of the rotary valve disc, and the second predetermined valve may be set lower the first predetermined valve.

The present invention may further include: a valve bypass passage portion communicating with a downstream portion and an upstream side portion of the rotary valve disc; and a bypass valve mechanically interlocked with the first thermostat to restrict the coolant from flowing through the valve bypass passage portion with the first thermostat closed, and the bypass valve releasing restriction of the coolant flowing through the valve bypass passage portion with the first thermostat opened.

In the present invention, the bypass valve may restrict or release the coolant flowing through the valve bypass passage portion in response to a difference between a coolant pressure at the upstream side of the rotary valve disc and a coolant pressure at the downstream side of the rotary valve member.

The present invention may further include a detection portion detecting or estimating a phase of the rotary valve disc.

Effects of the Invention

According to the present invention, the coolant flow can be controlled with high reliability while simplifying a coolant circuit, in a case of flowing the coolant through the engine.

MODES FOR CARRYING OUT THE INVENTION

Embodiments will be described with reference to drawings.

First Embodiment

Figure 1:
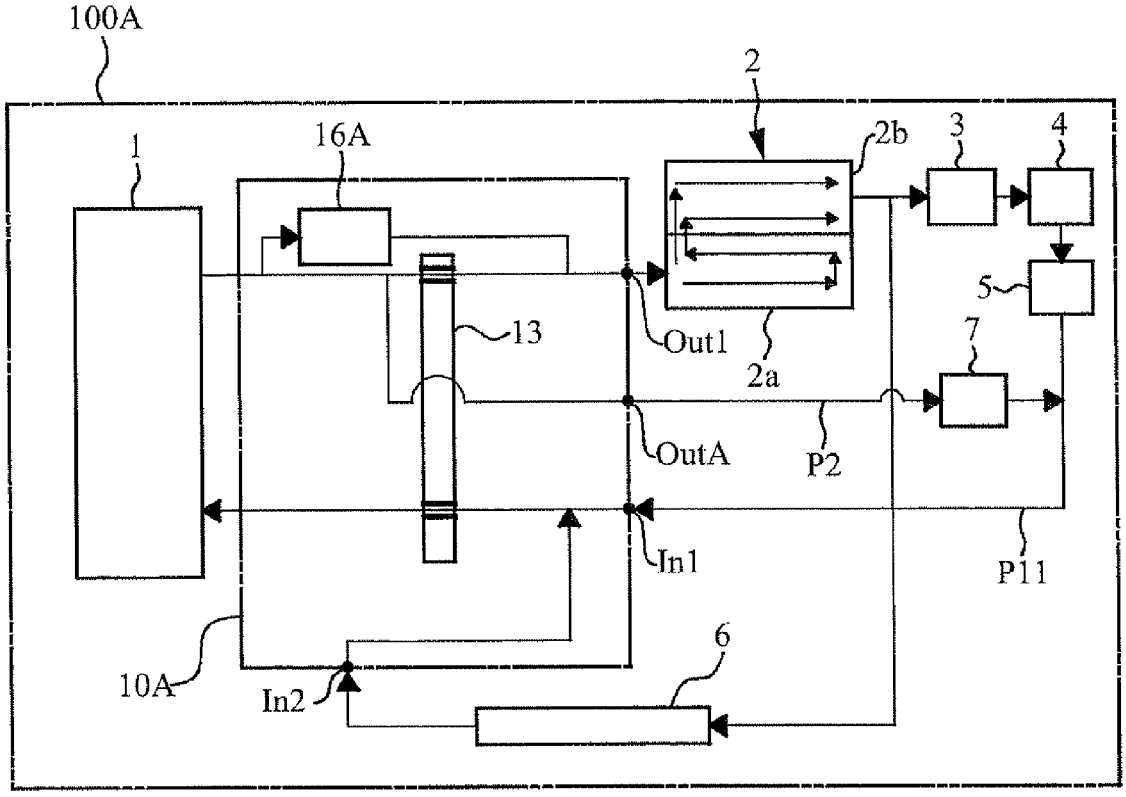
FIG. 1 is a schematic configuration view of a cooling circuit of an engine of a first embodiment.

FIG. 1 is a schematic configuration view of a cooling circuit of an engine (hereinafter, referred to as a cooling circuit) of a first embodiment. The cooling circuit 100A includes: a water pump (hereinafter, referred to as W/P) 1; an engine 2; an oil cooler 3; a heater 4; an Automatic Transmission Fluid (ATF) warmer 5; a radiator 6; an electronically controlled throttle 7; and a rotary valve 10A. The cooling circuit 100A is installed in a vehicle not illustrated.

The W/P 1 circulates the coolant through the engine 2. The W/P 1 is a mechanical pump driven by the output of the engine 2. The W/P 1 may be an electrically driven type. The coolant discharged from the W/P 1 flows to the engine 2 and the electronically controlled throttle 7 through the rotary valve 10A. When the coolant flows into the engine 2, the coolant flows from the rotary valve 10A through an outlet portion Out1. Also, when the coolant flows into the electronically controlled throttle 7, the coolant flows from the rotary valve 10A through an outlet portion OutA.

The engine 2 is provided with a cooling path such that the coolant flows to a cylinder block 2*a* and a cylinder head 2*b* in this order, and then discharges from the cylinder head 2*b*.

The coolant which has flowed through the engine 2 partially flows through the oil cooler 3, the heater 4, and the ATF warmer 5, and the remaining coolant flows through the radiator 6. The oil cooler 3 exchanges heat between a lubricating oil and the coolant of the engine 2 to cool the lubricating oil. The heater 4 exchanges heat between the air and the coolant to heat the air. The heated air is used for heating in the vehicle. The ATF warmer 5 exchanges heat between the ATF and the coolant to heat the ATF. The radiator 6 exchanges heat between the air and the coolant to cool the coolant.

The coolant which has flowed through the oil cooler 3, the heater 4, and the ATF warmer 5 returns to the W/P 1 through the rotary valve 10A. At this time, the coolant flows into the rotary valve 10A through the inlet portion In1. Also, the coolant which has flowed through the radiator 6 flows into the rotary valve 10A through the inlet portion In2. A flow path passing through the oil cooler 3, the heater 4, and the ATF warmer 5 is a first radiator bypass path P11 bypassing the radiator 6.

After the coolant which has flowed into the electronically controlled throttle 7, the coolant flows into the first radiator bypass path P11. The coolant flows through the electronically controlled throttle 7 to prevent the operational trouble caused by freezing. A flow path passing through the electronically controlled throttle 7 is an engine bypass path P2 bypassing the engine 2.

Figure 2:
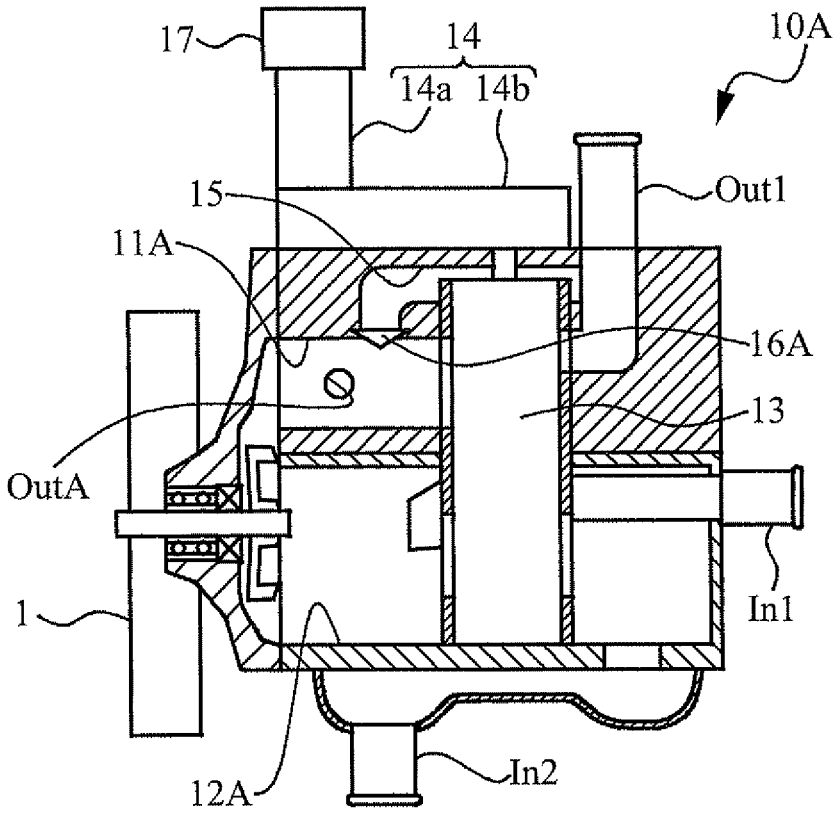
FIG. 2 is a schematic configuration view of a rotary valve of the first embodiment.

FIG. 2 is a schematic configuration view of a rotary valve 10A. FIG. 2 illustrates the W/P and the rotary valve 10A. As illustrated in FIGS. 1 and 2, the rotary valve 10A includes: a first passage portion 11A; a second passage portion 12A; a rotary valve disc 13; a drive portion 14; a valve disc bypass passage portion 15; a first bypass valve 16A, and a detection portion 17. Further, the rotary valve 10A includes: inlet portions In1 and In2; and outlet portions Out1 and OutA.

The first passage portion 11A is provided between a coolant outlet portion of the W/P 1 and the engine 2, and the coolant flows through the first passage portion 11A. The second passage portion 12A is provided between a coolant inlet portion of the W/P 1 and the radiator 6, and the coolant flows through the second passage portion 12A. The passage portions 11A and 12A are arranged side by side. The passage portions 11A and 12A connect with ends of the W/P 1 with the passage portions 11A and 12 arranged side by side. In addition, the first passage portion 11A connects with the coolant outlet portion of the pump 1, and the second passage portion 12A connects with the coolant inlet portion of the pump 1. The W/P 1 is arranged at the upstream side of the first passage portion 11A. The W/P 1 is arranged at the downstream side of the second passage portion 12A.

The rotary valve disc 13 is interposed in the first passage portion 11A and the second passage portion 12A. The rotary valve disc 13 rotates to change the flow of the coolant flowing through the first passage portion 11A and the flow of the coolant flowing through the second passage portion 12A. The rotary valve disc 13 prohibits and allows the flow of the coolant flowing through the first passage portion 11A and the flow of the coolant flowing through the second passage portion 12A, and restricts them and releases the restriction. The drive portion 14 includes an actuator 14*a* and a gear box portion 14*b*, and drives the rotary valve disc 13. Specifically, the actuator 14*a* is an electric motor.

The valve disc bypass passage portion 15 communicates with the upstream side and the downstream side of the rotary valve disc 13 in the first passage portion 11A. The first bypass valve 16A is a differential pressure valve, and restricts (specifically, prohibits) the coolant from flowing through the valve disc bypass passage portion 15 or releases the restriction (specifically, allows) in response to a difference between the coolant pressure at the upstream side of the rotary valve disc 13 (upstream side pressure) and the coolant pressure at the downstream side thereof (downstream side pressure) in the first passage portion 11A.

Specifically, the first bypass valve 16A prohibits the coolant from flowing through the valve disc bypass passage portion 15, when the differential pressure obtained by subtracting the downstream side pressure from the upstream side pressure is a predetermined magnitude or less. The first bypass valve 16A allows the coolant to flow through the valve disc bypass passage portion 15, when the differential pressure is higher than a predetermined magnitude. A predetermined magnitude may be set higher than the maximum differential pressure which is obtained in a normal state.

The detection portion 17 is provided at a drive shaft of the actuator 14*a*. The detection portion 17 detects the rotational angle of the drive shaft of the actuator 14*a*. This enables the phase of the rotary valve disc 13 to be detected or estimated. For example, the detection portion 17 may be provided at a rotational shaft of the rotary valve disc 13.

The first passage portion 11A communicates with the outlet portion Out1 at the downstream of the rotary valve disc 13, and communicates with the outlet portion OutA at the upstream of the rotary valve disc 13. Thus, the coolant is discharged through the outlet portion Out1 from the downstream side of the rotary valve disc 13 in the first passage portion 11A. Also, the coolant is discharged through the outlet portion OutA from the upstream side of the rotary valve disc 13 in the first passage portion 11A.

The second passage portion 12A communicates with the inlet portion In1 at the downstream side of the rotary valve disc 13, and communicates with the inlet portion In2 at the upstream side of the rotary valve disc 13. Thus, the coolant flows through the inlet portion In1 to the downstream side of the rotary valve disc 13 in the second passage portion 12A. Also, the coolant flows through the inlet portion In2 to the upstream side of the rotary valve disc 13 in the second passage portion 12A.

Figure 3A:
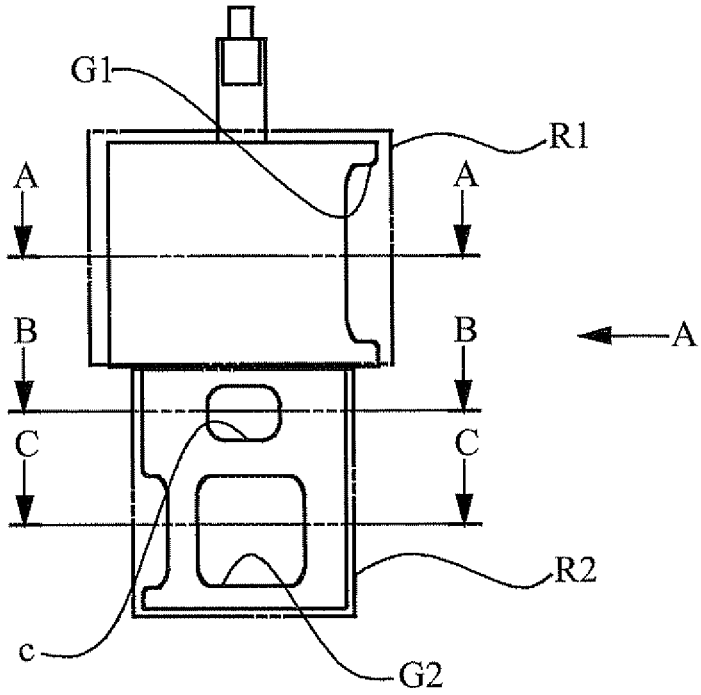
FIGS. 3A and 3B are schematic configuration views of a rotary valve disc.
Figure 3B:
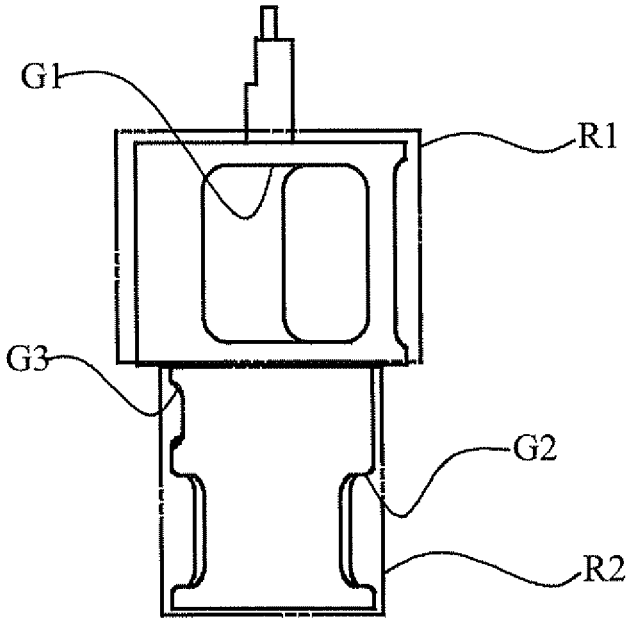
Figure 4A:
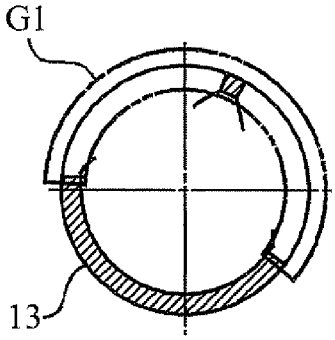
FIGS. 4A to 4C are main sectional views of the rotary valve disc.
Figure 4B:
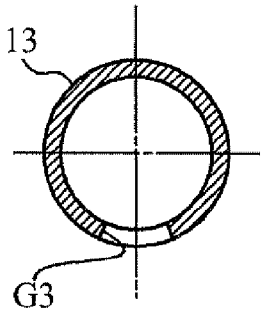
Figure 4C:
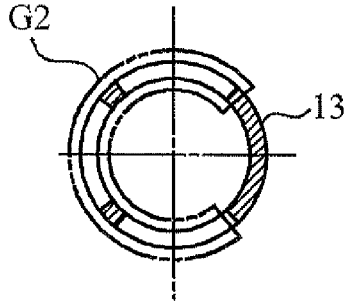

FIGS. 3A and 3B are schematic configuration views of the rotary valve disc 13. FIGS. 4A to 4C are main sectional views of the rotary valve disc 13. FIG. 3A illustrates the rotary valve disc 13 when viewed from its side. FIG. 3B illustrates the rotary valve disc 13 when viewed in the direction of an arrow A of FIG. 3A. FIG. 4A is a sectional view taken along line A-A of FIG. 3A. FIG. 4B is a sectional view taken along line B-B of FIG. 3A. FIG. 4C is a sectional view taken along line C-C of FIG. 3A.

The rotary valve disc 13 includes: a first valve disc portion R1 located in the first passage portion 11A; and a second valve disc portion R2 located in the second passage portion 12A. The valve disc portions R1 and R2 each have a cylindrical shape with a hollow. In this regard, the inside of the valve disc portion R1 and the inside of the valve disc portion R2 communicate with each other.

A first aperture G1 is provided in the first valve disc portion R1, and a second aperture G2 is provided in the second valve disc portion R2. The apertures G1 and G2 have different phases. The first aperture G1 is formed by combining two apertures divided by a pillar, and the second aperture G2 is formed by combining three apertures divided by a pillar.

The first aperture G1 can allow the coolant to flow through the engine 2 with the first aperture G1 opening to the upstream and downstream sides of the first passage portion 11A. Moreover, the first aperture G1 can prohibit the coolant from flowing to the engine 2 with the first aperture G1 opening to only one of the upstream and downstream sides of the first passage portion 11A. The first aperture G1 can adjust the coolant rate flowing through the engine 2 in response to the phase of the rotary valve disc 13 with the first aperture G1 opening to the upstream and downstream sides of the first passage portion 11A.

The second aperture G2 can allow the coolant to flow therethrough with the second aperture G2 opening to the upstream and downstream sides of the second passage portion 12A. Moreover, the second aperture G2 can prohibit the coolant from flowing therethrough with the second aperture G2 opening to only one of the upstream and downstream sides of the second passage portion 12A.

A third aperture G3 is further provided in the second valve disc portion R2. The third aperture G3 is provided at a position different from that of the second aperture G2 in the axial direction. The third aperture G3 is provided to open to the downstream side of the second passage portion 12A, when the third aperture G3 is located at the downstream side of the second passage portion 12A with the second aperture G2 opening to the upstream and downstream sides of the second passage portion 12A. On the other hand, the third aperture G3 is provided not to open to the upstream side of the second passage portion 12A, when the third aperture G3 is located at the upstream side of the second passage portion 12A with the second aperture G2 opening to the upstream and downstream sides of the second passage portion 12A.

Thus, the coolant can be allowed to flow through the third aperture G3, when the third aperture G3 is located at the downstream side of the second passage portion 12A. At this time, the coolant can be allowed to flow through the apertures G2 and G3. On the other hand, the coolant can be prohibited from flowing through the third aperture G3, when the third aperture G3 is located at the upstream side of the second passage portion 12A. At this time, the coolant can be allowed to flow through the second aperture G2, selected from the apertures G2 and G3.

When the third aperture G3 is located at the upstream side of the second passage portion 12A, it is also possible to gradually increase or decrease the coolant flow rate flowing from the upstream side to the downstream side of the second passage portion 12A where the rotary valve disc 13 is interposed, in response to the phase of the rotary valve disc 13, with the second aperture G2 opening to the upstream and downstream sides of the second passage portion 12A. When the third aperture G3 is located at the upstream side of the second passage portion 12A, it is also possible to gradually increase or decrease the coolant flow rate flowing from the upstream side to the downstream side of the second passage portion 12A where the rotary valve disc 13 is interposed, in response to the phase of the rotary valve disc 13, with the second apertures G2 and G3 opening to the upstream and downstream sides of the second passage portion 12A.

The rotary valve disc 13 configured in such a way can simultaneously control the coolant flowing through the first passage portion 11A and the coolant flowing through the second passage portion 12A in response to the rotational movement of the rotary valve disc 13. In addition, it is possible to restrict the coolant flow rate flowing from the upstream side to the downstream side of the second passage portion 12A where the rotary valve disc 13 is interposed.

Returning to FIGS. 1 and 2, the first passage portion 11A communicating with the outlet portion OutA at the upstream side of the rotary valve disc 13 branches off to the engine bypass path P2 at the upstream side of the rotary valve disc 13.

Thus, the rotary valve 10A allows the coolant to flow through the engine bypass path P2, when the rotary valve disc 13 in the first passage portion 11A prohibits the coolant from flowing through the engine 2.

The second passage portion 12A communicating with the inlet portion In2 at the upstream side of the rotary valve disc 13 communicates with the radiator 6 at the upstream side of the rotary valve disc 13. Thus, the rotary valve disc 13 restricts the coolant flow rate flowing from the upstream side to the downstream side of the second passage portion 12A where the rotary valve disc 13 is interposed, whereby the rotary valve 10A can restrict the coolant flow rate flowing through the radiator 6.

Figure 5:
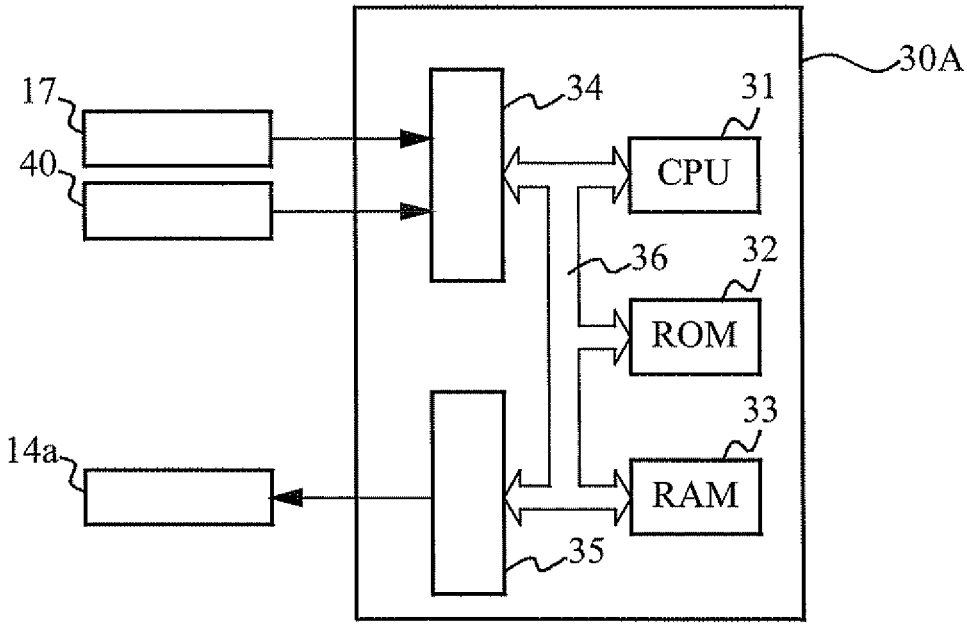
FIG. 5 is a schematic configuration view of an ECU.

FIG. 5 is a schematic configuration view of an ECU 30A. The ECU 30A is provided with a microcomputer including a CPU 31, a ROM 32, and a RAM 33, and is provided with input and output circuits 34 and 35. These components connect with each other through a bus 36. The ECU 30A electrically connects with the detection portion 17 and sensors 40 for detecting the drive state of the engine 2 through the input circuit 34. Also, the ECU 30A electrically connects with the actuator 14*a* through the output circuit 35.

The sensors 40 includes a sensor for detecting the speed NE of the engine 2, a sensor for detecting the load of the engine 2, and a sensor for detecting a temperature ethw of the coolant in the engine 2. For example, the temperature ethw is a temperature of the coolant just after the coolant flows out of the engine 2. For example, the sensors may indirectly connect with the engine 2 through a control unit controlling the engine 2. For example, the ECU 30A may be a control unit controlling the engine 2.

The ECU 30A is an electronic controller corresponding to a control portion, and controls the rotary valve 10A. For example, the ECU 30A can control the rotary valve 10A in response to the drive state of the engine 2 such as the speed NE of the engine 2, the load of the engine 2, or the coolant temperature ethw. Also, the ECU 30A can estimate or detect the phase of the rotary valve disc 13 based on the output of the detection portion 17 in controlling the rotary valve 10A.

The present embodiment achieves an engine cooling system (hereinafter referred to as cooling system 1A) including the passage portions 11A and 12A and the rotary valve disc 13. Specifically, this cooling system 1A includes: the ECU 30A; and the rotary valve 10A including the passage portions 11A and 12A and the rotary valve disc 13.

Next, the effects of the cooling system 1A will be described. In a case of flowing the coolant through the engine 2, for example, in the cooling circuit 100A, there may be individually provided a flow rate adjustment valve adjusting the coolant flow rate flowing through the engine 2 and a flow rate adjustment valve adjusting the coolant flow rate flowing through the radiator 6, instead of the rotary valve 10A.

However, the provision of two flow rate adjustment valves individually complicates the cooling circuit 100A in this case. As a result, there may be a disadvantage in cost, or there may be a degradation in the installation in a vehicle. Further, in a case of individually providing two flow rate adjustment valves, there may cause a fatal situation such that the engine 2 is overheated, for example, when a failure occurs at any one of two flow rate adjustment valves. Furthermore, in a case of individually providing two flow rate adjustment valves, the individual difference has to be considered. Thus, the flow may not be controlled certainly.

In contrast, the cooling system 1A simultaneously controls the coolant flowing through the first passage portion 11A and the coolant flowing through the second passage portion 12A in response to the rotational operation of the rotary valve disc 13. Thus, the cooling system 1A controls the coolant flow with high reliability with the cooling circuit 100A simplified, when the cooling system 1A causes the coolant to flow through the engine 2.

In this regard, in a case of incorporating the cooling system 100A, the cooling system 1A may be provided to the W/P 1, because the cooling system 1A simultaneously controls the coolant flowing through the inlet and outlet of the W/P 1. Preferably, the cooling system 1A is directly provided to the W/P 1 to suitably simplify the cooling circuit 100A.

The cooling system 1A includes: the ECU 30A; and the electric motor driven rotary valve 10A including the passage portions 11A and 12A and the rotary valve disc 13. Thus, the cooling system 1A can control the flow of the coolant with high responsivity. Also, the highly-functional control of the coolant flow can be performed as will be described below.

That is, the rotary valve 10A allows the coolant to flow through the engine bypass path P2, when the rotary valve disc 13 restricts the coolant from flowing through the first passage portion 11A in the cooling system 1A. In this case, the cooling system 1A can suitably accelerate the warming-up of the engine 2.

Also, in the cooling system 1A, the rotary valve disc 13 restricts the coolant flow rate flowing from the upstream side to the downstream side of the second passage portion 12A where the rotary valve disc 13 is interposed, whereby the rotary valve 10A restricts the coolant flow rate flowing thereto through the radiator 6. This adjusts the temperature of the coolant flowing through the engine 2.

Specifically, in the cooling system 1A, for example, the rotary valve disc 13 prohibits the coolant from flowing through the apertures G2 and G3, whereby the rotary valve 10A can prohibit the coolant from flowing through the radiator 6. Also, at this time, the rotary valve 10A can flow the coolant bypassing the radiator 6 to the downstream side of the rotary valve disc 13 in the second passage portion 12A. Thus, in this situation, the coolant can flow through the engine 2 while not interrupting the warm up of the engine 2.

Also, in the cooling system 1A, for example, the rotary valve disc 13 allows the coolant to flow through the aperture G2, selected from the apertures G2 and G3, that is, the rotary valve disc 13 allows a low flow rate of the coolant to flow through the radiator 6. This can reduce the temperature of the coolant to flow through the engine 2, as compared to a case where the coolant is prohibited from flowing through the radiator 6.

Further, in the cooling system 1A, for example, the rotary valve disc 13 allows the coolant to flow through the apertures G2 and G3, that is, the rotary valve disc 13 allows a high flow rate of the coolant to flow through the radiator 6. This can further reduce the temperature of the coolant to flow through the engine 2, as compared to a case where the coolant is allowed to flow through the aperture G2, selected from the apertures G2 and G3.

Furthermore, in the cooling system 1A, for example, it is possible to gradually increase or decrease the coolant flow rate which flows from the upstream side to the downstream side in the second passage portion 12A where the rotary valve disc 13 is interposed, in response to the phase of the rotary valve disc 13. Therefore, the cooling system 1A can precisely control the temperature of the coolant to flow through the engine 2.

In a case of controlling the coolant flow in such a way, specifically, for example, when the engine 2 is in a low load state, the ECU 30A controls the rotary valve 10A to restrict the coolant flow rate flowing from the upstream side to the downstream side in the second passage portion 12A where the rotary valve disc 13 is interposed.

In the cooling system 1A, the rotary valve disc 13 allows the maximum flow rate of the coolant to flow through the apertures G2 and G3, thereby maximally reducing the temperature of the coolant to flow through the engine 2.

In a case of controlling the coolant flow in such a way, specifically, for example, when the engine 2 is in a high load state, the ECU 30A controls the rotary valve 10A to allow the maximum flow rate of the coolant flowing from the upstream side to the downstream side in the second passage portion 12A where the rotary valve disc 13 is interposed.

Figure 6:
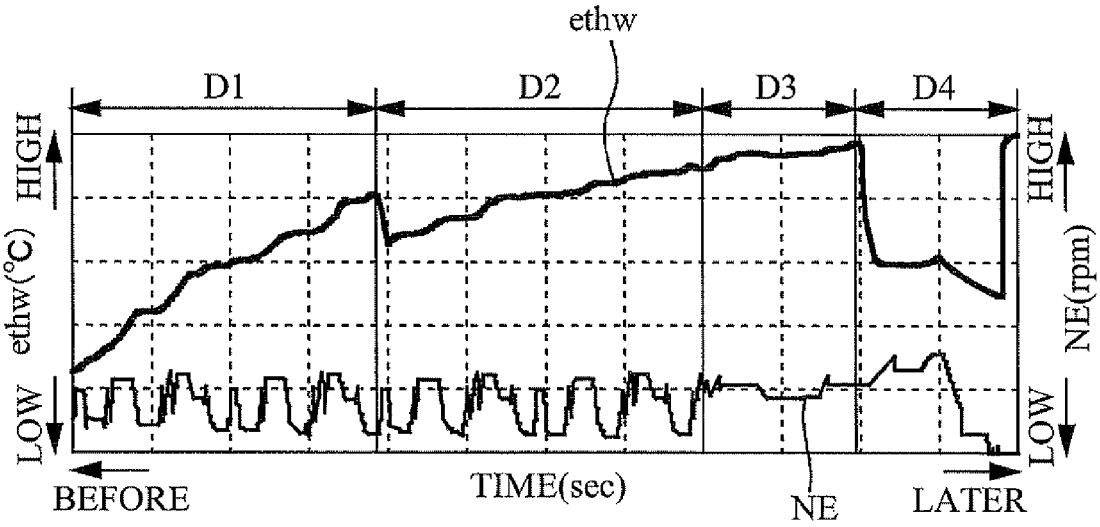
FIG. 6 is a view of an example of a change in temperature of a coolant.

FIG. 6 is a view of an example of a change in the coolant temperature ethw in a vehicle driving state. A region D1 corresponds to a case where the coolant is prohibited from flowing through the engine 2. A region D2 corresponds to a case where the coolant is prohibited from flowing through the radiator 6. A region D3 corresponds to a case where the low flow rate of the coolant is allowed to flow through the radiator 6. A region D4 corresponds to a case where the high flow rate of the coolant is allowed to flow through the radiator 6. FIG. 6 illustrates a change in the speed NE of the engine 2 as reference. Thus, the vertical axis indicates the temperature ethw and the speed NE, and the horizontal axis indicates time.

It can be seen from FIG. 6, that the coolant prohibited from flowing through the engine 2 in the region D1 results in that the temperature ethw increases by a high degree. It can be seen that the coolant prohibited from flowing through the radiator 6 in the region D2 results in that the temperature ethw increases by a degree lower than that in region D1. It can be seen that the small flow rate of the coolant allowed to flow through the radiator 6 in the region D3 results in that the temperature ethw increases to a degree further lower than the degree in region D2. It can be seen that the high flow rate of the coolant allowed to flow through the radiator 6 in the region D4 results in that the temperature ethw drastically decreases.

The cooling system 1A includes the first bypass valve 16A. Thus, the cooling system 1A allows the coolant to flow through the valve disc bypass passage portion 15, when the pressure drastically increases at the upstream side of the rotary valve disc 13 in the first passage portion 11A.

Therefore, the cooling system 1A can prevent the engine 2 from being overheated, for example, in a case where the rotary valve disc 13 is not operated by a trouble and then the coolant pressure increases at the outlet side of the W/P 1. Also, a system pressure is normally kept to suppress an increase in a driving force of the W/P 1, for example, in a case where the coolant pressure increases for some reason even when the operation of the rotary valve disc 13 does not have a particular trouble.

The cooling system 1A includes the detection portion 17 for detecting or estimating the phase of the rotary valve disc 13. That is, the cooling system 1A can simultaneously control the coolant flowing through the first passage portion 11A and the coolant flowing through the second passage portion 12A in response to the rotational operation of the rotary valve disc 13. It is thus unnecessary for the cooling system 1A to include sensors which respectively detect or estimate these coolant control, whereby there is an advantage of cost.

Second Embodiment

Figure 7:
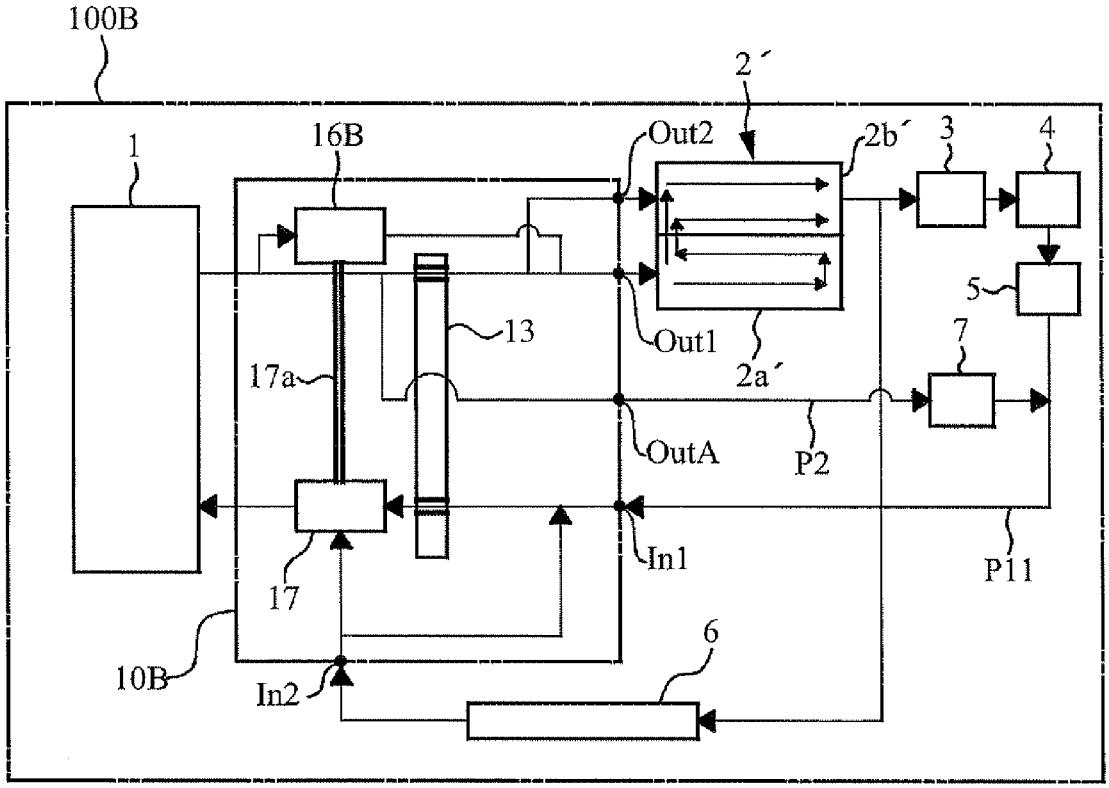
FIG. 7 is a schematic configuration view of a cooling circuit of an engine of a second embodiment.
Figure 8:
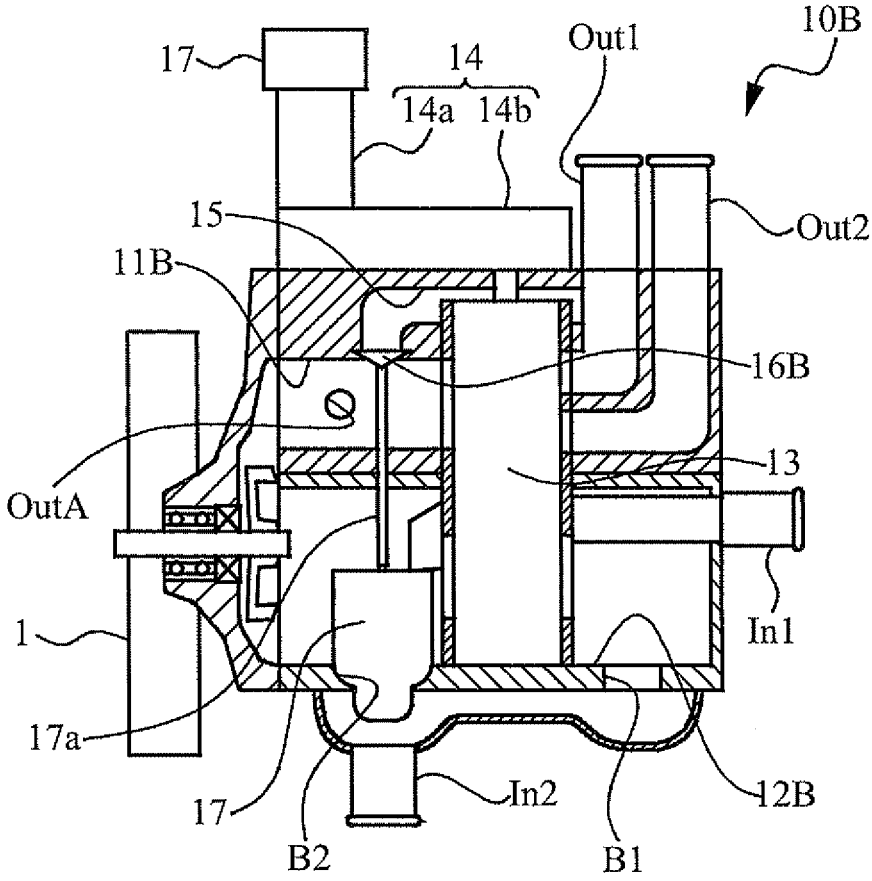
FIG. 8 is a schematic configuration view of a rotary valve of the second embodiment.

FIG. 7 is a schematic configuration view of a cooling circuit 100B of a second embodiment. FIG. 8 is a schematic configuration view of a rotary valve 10B. As illustrated in FIG. 7, the cooling circuit 100B is substantially the same as the cooling circuit 100A, except that the cooling circuit 100B includes an engine 2' and the rotary valve 10B instead of the engine 2 and the rotary valve 10A, and a cooling path is changed in accordance with this.

As illustrated in FIGS. 7 and 8, the rotary valve 10B is substantially the same as the rotary valve 10A, except that the rotary valve 10B includes: a first passage portion 11B instead of the first passage portion 11A; a second passage portion 12B instead of the second passage portion 12A; a first bypass valve 16B instead of the first bypass valve 16A; a first thermostat 17; and an outlet portion Out2.

The engine 2' includes a cylinder block 2*a'* and a cylinder head 2*b'* through which the coolant individually flows, as illustrated in FIG. 7. In response to this, in the rotary valve 10B, the coolant is discharged from the outlet portions Out1 and Out2 to flow through the engine 2'. The coolant has been discharged from the outlet portion Out1 flows to the cylinder block 2*a'*, and the coolant discharged from the outlet portion Out2 flows to the cylinder head 2*b'*.

The engine 2' is provided with a following cooling path. That is, the cooling path is provided such that the coolant flows from the outlet portion Out1 to the cylinder block 2*a'* and the cylinder head 2*b'* in this order, the coolant flows from the outlet portion Out2 to the cylinder head 2*b'*, and these coolants join each other in the cylinder head 2*b'* to be discharged from the cylinder head 2*b'*.

As illustrated in FIG. 8, the first passage portion 11B is substantially the same as the first passage portion 11A, except that the first the passage portion 11B is further provided with the outlet portion Out2 and branches off to the cylinder block 2*a'* and the cylinder head 2*b'* at the downstream side of the rotary valve disc 13. In this regard, a part of the first the passage portion 11B branching off to the cylinder block 2*a'* communicates with the outlet portion Out1, and the other part branching off to the cylinder head 2*b'* communicates with the outlet portion Out2. The first passage portion 11B branches off so as to perform the following flow control in response to the phase of the rotary valve disc 13.

That is, the first the passage portion 11B branches off to prohibit the coolant from flowing through the cylinder block 2*a'* and the cylinder head 2*b'* in response to the phase of the rotary valve disc 13. Further, the first the passage portion 11B branches off to prohibit the coolant from flowing through the cylinder block 2*a'* and allow the coolant to flow through the cylinder head 2*b'*. Furthermore the first the passage portion 11B branches off to allow the coolant to flow through the cylinder block 2*a'* and the cylinder head 2*b'*.

Thus, the rotary valve disc 13 restricts (specifically, prohibits) the coolant from flowing through the cylinder block 2*a'* and the cylinder head 2*b'*, whereby the rotary valve 10B restricts the coolant from flowing through the cylinder block 2*a'* and the cylinder head 2*b'*.

Moreover, the rotary valve disc 13 restricts (specifically, prohibits) the coolant from flowing to the cylinder block 2*a'* and releases the restriction (specifically, allows) on the coolant flowing to the cylinder head 2*b'*, whereby the rotary valve 10B causes the coolant to preferentially flow to the cylinder head 2*b'*, selected from the cylinder head 2*b'* and the cylinder block 2*a'*. In this regard, the rotary valve 10B causes the coolant to preferentially flow to the cylinder head 2*b'*, selected from the cylinder head 2*b'* and the cylinder block 2*a'*, even when the coolant is not allowed to flow through the cylinder block 2*a'*.

Further, the rotary valve disc 13 releases the restriction on (specifically, allows) the coolant flowing to the cylinder block 2*a'* and the cylinder head 2*b'*, whereby the rotary valve 10B allows the coolant to flow through the cylinder block 2*a'* and the cylinder head 2*b'*.

Specifically, in order to perform the flow control in such a way, the first passage portion 11B branches off to correspond to the different phase of the rotary valve disc 13. Additionally, FIG. 8 illustrates the first passage portion 11B branching off to correspond to the same phase of the rotary valve disc 13 for convenience of illustration. In this regard, for example, even in a case where the first passage portion 11B branches off to correspond to the same phase of the rotary valve disc 13, the same structure of the second valve disc portion R2 is applied to the first valve disc portion R1 in the rotary valve disc 13, and the first passage portion 11B branches off to correspond to the apertures G2 and G3. This also enables the above mentioned flow control.

The second passage portion 12B is substantially the same as the second passage portion 12A, except that the downstream side of the rotary valve disc 13 in the second passage portion 12B communicates with the inlet portion In2 through the first thermostat 17. The downstream side of the rotary valve disc 13 communicates with the inlet portion In2 through the first thermostat 17, whereby the second passage portion 12B communicates with the radiator 6 through first thermostat 17 at the downstream side of the rotary valve disc 13.

Herein, specifically, the second passage portion 12B includes: a first communication portion B1 communicating the upstream side of the rotary valve disc 13 with the inlet portion In2; and a second communication portion B2 communicating the downstream side of the rotary valve disc 13 with the inlet portion In2. On the other hand, specifically, the first thermostat 17 is provided in the second communication portion B2. The first thermostat 17 opens when the coolant temperature is higher than a first predetermined value. The first thermostat 17 closes when the coolant temperature is the first predetermined value or lower.

The first bypass valve 16B is substantially the same as the first bypass valve 16A, except that the first bypass valve 16B mechanically interlocks with the first thermostat 17.

In this regard, the first thermostat 17 is provided with an operational shaft 17*a*, which extends and is interposed in the passage portions 11B and 12B to interlock with the first bypass valve 16B. Further, the first bypass valve 16B is driven by the operational shaft 17*a* to prohibit the coolant from flowing through the valve disc bypass passage portion 15 with the first thermostat 17 closed. The first bypass valve 16B allows the coolant to flow through the valve disc bypass passage portion 15 with the first thermostat 17 opened.

In order for the first bypass valve 16B to be a differential pressure valve and to mechanically interlock with the first thermostat 17, for example, the first bypass valve 16B is provided with a valve structure which is opened by a differential pressure, and the whole first bypass valve 16B mechanically interlocks with the first thermostat 17.

An ECU 30B is provided for the rotary valve 10B. The ECU 30B, as described below, is substantially the same as the ECU 30A, except that the rotary valve 10B is controlled. Thus, the illustration of the ECU 30B is omitted. The ECU 30B controls the rotary valve 10B to restrict the flow rate of the coolant flowing from the upstream side to the downstream side of the second passage portion 12B where the rotary valve disc 13 is interposed, when the coolant temperature ethw is significantly lower than the first predetermined value (lower than a predetermined value lower than the first predetermined value).

The present embodiment achieves a cooling system 1B including the passage portions 11B and 12B and the rotary valve disc 13. Specifically, the cooling system 1B includes the ECU 30B and the rotary valve 10B including the passage portions 11B and 12B and the rotary valve disc 13.

Next, the effects of the cooling system 1B will be described. In the cooling system 1B, the rotary valve 10B causes the coolant to preferentially flow through the cylinder head 2*b*', selected from the cylinder block 2*a*' and the cylinder head 2*b*'. Thus, the cooling system 1B further accelerates the warming-up of the cylinder block 2*a*', as compared with the cooling system 1A. It is therefore possible to reduce the friction loss of the cylinder block 2*a*' and to cool the cylinder head 2*b*'.

In this regard, in order to flow the coolant in such a way, specifically, for example, when the coolant temperature is lower than a predetermined value (for example, a minimum value), the ECU 30B controls the rotary valve 10B to cause the coolant to preferentially flow through the cylinder head 2*b*', selected from the cylinder block 2*a*' and the cylinder head 2*b*'.

In the cooling system 1B, for example, even when the coolant temperature is close to the first predetermined value and the rotary valve disc 13 stops at a predetermined phase, the first thermostat 17 can control the coolant temperature. Thus, the cooling system 1B reduces a frequency of operation of the rotary valve disc 13 to further improve the endurance of the rotary valve 10B, as compared to the cooling system 1A.

In this regard, the ECU 30B controls the rotary valve 10B as mentioned above, whereby the cooling system 1B can control the rotary valve 10B to stop the rotary valve disc 13 at an arbitrary phase and the first thermostat 17 can adjust the coolant temperature, when the coolant temperature is close to the first predetermined value.

In the cooling system 1B, for example, even when the rotary valve disc 13 does not operate due to a failure, the first bypass valve 16B can cause the coolant to flow through the valve disc bypass passage portion 15 in response to the operation of the thermostat 17, before the engine 2' is overheated. Therefore, the cooling system 1B can prevent the engine 2' from being overheated.

Also, the first predetermined value is set to be the maximum value in a suitable temperature range, whereby the cooling system 1B can immediately increase the coolant flow rate flowing through the engine 2' when the coolant temperature exceeds the suitable temperature range. Thus, the cooling system 1B, as compared to the cooling system 1A, can immediately cool the engine 2 when a high cooling performance is required.

Thus, in the cooling system 1B, as compared to the cooling system 1A, the rotary valve 10B can be made to further have a high functionality, and the rotary valve 10B can be made to reasonably have a high functionality, thereby suitably simplifying the cooling circuit 100B. Further, the coolant flow is controlled with reliability higher than that of the cooling system 1A.

Third Embodiment

Figure 9:
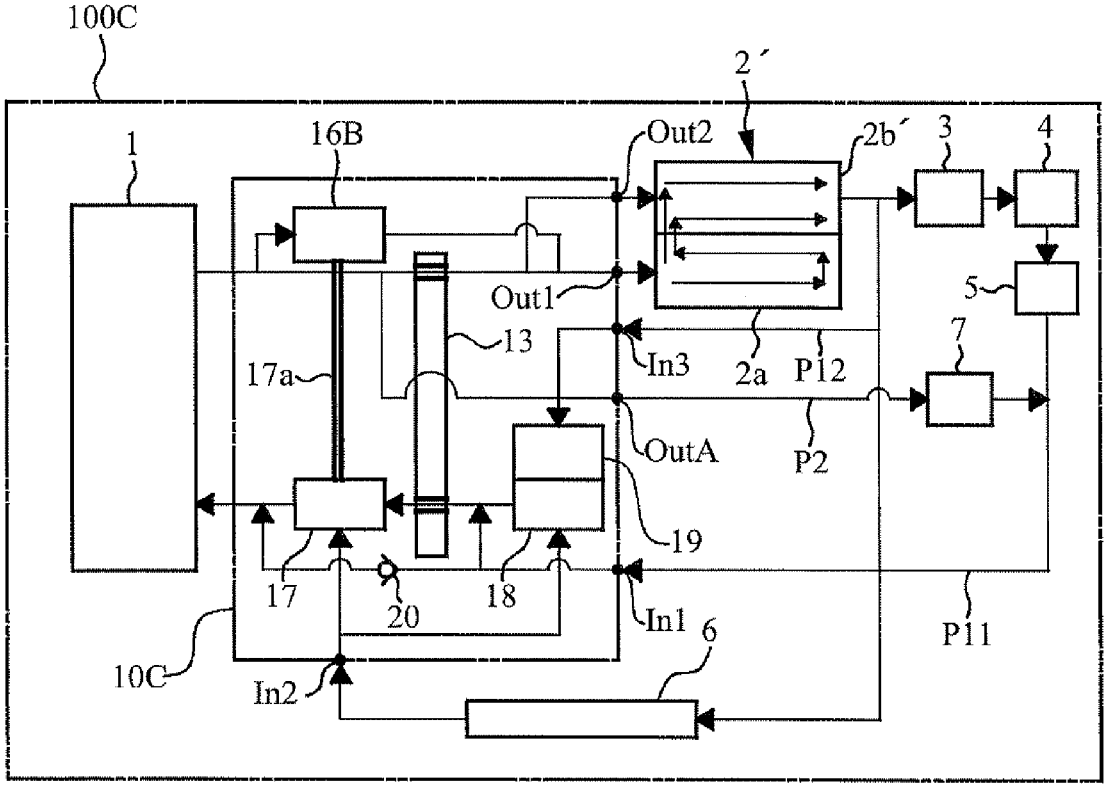
FIG. 9 is a schematic configuration view of a cooling circuit of an engine of a third embodiment.
Figure 10:
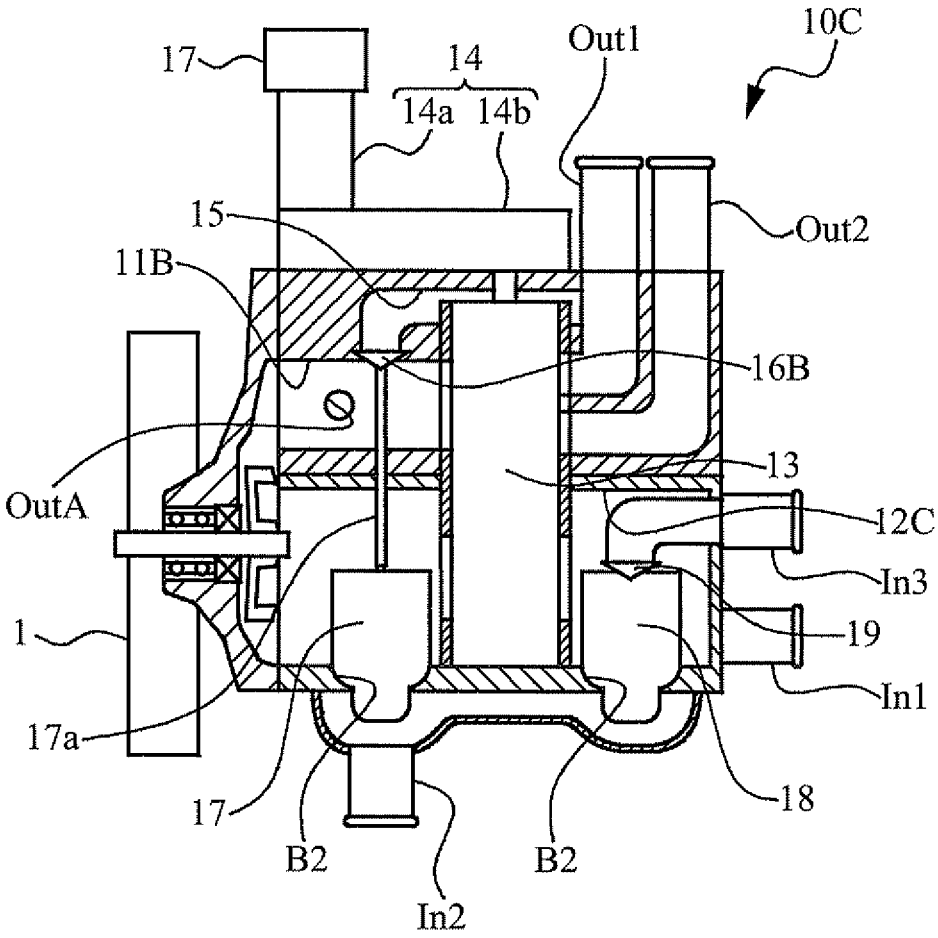
FIG. 10 is a schematic configuration view of a rotary valve of the third embodiment.

FIG. 9 is a schematic configuration view of a cooling circuit 100C. FIG. 10 is a schematic configuration view of a rotary valve 10C. As illustrated in FIG. 9, the cooling circuit 100C is substantially the same as the cooling circuit 100B, except that the rotary valve 10C is provided instead of the rotary valve 10B, and in accordance with this, the cooling path is changed. As illustrated in FIGS. 9 and 10, the rotary valve 10C is substantially the same as the rotary valve 10B, except that the rotary valve 10C includes: a second passage portion 12C instead of the second passage portion 12B; a second thermostat 18; a second bypass valve 19; a check valve 20; and an inlet portion In3.

As illustrated in FIG. 9, in a cooling circuit 100C, the coolant which have flowed through the engine 2' partially flows to the rotary valve 10C through the inlet portion In3. This flow path is a second radiator bypass path P12 bypassing the radiator 6. Thus, the coolant which has flowed through the first radiator bypass path P11 flows to the rotary valve 10C through the inlet portion In1. Also, the coolant which has flowed through the second radiator bypass path P12 flows through the inlet portion In3.

As illustrated in FIGS. 9 and 10, the second passage portion 12C is substantially the same as the second passage portion 12B, except that the inlet portion In1 communicates with the upstream side of the rotary valve disc 13 and the downstream side thereof, and the inlet portion In3 is provided. Additionally, a state where the inlet portion In1 communicates with the upstream and downstream sides of the second passage portion 12C is omitted in FIG. 10 for convenience of illustration. In accordance with this, the check valve 20 is omitted in FIG. 10. The inlet portion In3 communicates with the upstream side of the rotary valve disc 13 in the second passage portion 12C.

The second thermostat 18 is provided in the first communication portion B1. Thus, the upstream side of the rotary valve disc 13 in the second passage portion 12C communicates with the inlet portion In2 through the second thermostat 18. Therefore, the upstream side of the rotary valve disc 13 communicates with the radiator 6 through the second thermostat 18. When the coolant temperature is higher than a second predetermined valve, the second thermostat 18 opens. When the coolant temperature is the second predetermined value or lower, the second thermostat 18 closes. The second predetermined value is set to be lower than the first predetermined value. For example, the second value is set to be a minimum value in a suitable temperature range of the coolant.

The second bypass valve 19 opens or closes the inlet portion In3. The second bypass valve 19 mechanically interlocks with the second thermostat 18. Specifically, the second bypass valve 19 is coupled to an operational shaft (not illustrated) of the second thermostat 18. The second bypass valve 19 prohibits the coolant from flowing through the inlet portion In3 with the second thermostat 18 closing, and allows the coolant flowing through the inlet portion In3 with the second thermostat 18 opening.

The check valve 20 controls the coolant which has flowed through the inlet portion In1. Specifically, when the coolant which has flowed through the inlet portion In1 flows from the upstream side to the downstream side of the second passage portion 12C, the check valve 20 allows the coolant to flow from the upstream side to the downstream side and prohibits the coolant from flowing from the downstream side to the upstream side.

An ECU 30C is provided for the rotary valve 10C. The ECU 30C is substantially the same as the ECU 30B, except that the ECU 30C controls the rotary valve 10C as will be described later. Thus, illustration of the ECU 30C is omitted. The ECU 30C controls the rotary valve 10C to restrict the flow rate of the coolant flowing from the upstream side to the downstream side of the second passage portion 12C where the rotary valve disc 13 is interposed, when the coolant temperature ethw is significantly lower than the second predetermined value (lower than a predetermined value lower than the second predetermined value).

The present embodiment achieves a cooling system 1C including the passage portions 11B and 12C and the rotary valve disc 13. Specifically, the cooling system 1C includes the ECU 30C and the rotary valve 30C including the passage portions 11B and 12C and the rotary valve disc 13.

Next, the effects of the cooling system 1C will be described. In the cooling system 1C, for example, even when the coolant temperature is close to the second predetermined value and the rotary valve disc 13 stops at an arbitrary phase, the second thermostat 18 can control the coolant temperature. Thus, the cooling system 1C reduces a frequency of operation of the rotary valve disc 13 to further improve the endurance of the rotary valve 10C, as compared to the cooling system 1B.

In this regard, the ECU 30C controls the rotary valve 10C as mentioned above, whereby the cooling system 1C can control the rotary valve 10C to stop the rotary valve disc 13 at an arbitrary phase and the second thermostat 18 can adjust the coolant temperature, when the coolant temperature is close to the second predetermined value.

The cooling system 1C allows the coolant which is heat exchanged to flow to the rotary valve 10C through the first radiator bypass path P11, when the coolant temperature is lower than the second predetermined value. As a result, in a case where the warming up is accelerated with the coolant flowing through the engine 2', the coolant with a lower temperature is caused to flow through the engine 2', thereby suitably accelerating the warming up.

Thus, in the cooling system 1C, as compared to the cooling system 1B, the rotary valve 10C can be made to further have a high functionality, and the rotary valve 10C can be made to reasonably have a high functionality, thereby suitably simplifying the cooling circuit 100C. Further, the coolant flow is controlled with reliability higher than that of the cooling system 1B.

While the exemplary embodiments of the present invention have been illustrated in detail, the present invention is not limited to the above-mentioned embodiments, and other embodiments, variations and modifications may be made without departing from the scope of the present invention.

For example, in the second embodiment, the downstream side of the rotary valve disc 13 in the second passage portion 12B communicates with the radiator 6 through the first thermostat 17. However, the present invention is not limited to this. The upstream side of the rotary valve disc, selected from the upstream and downstream sides, in the second passage portion may communicate with a radiator through a first thermostat. In this case, a frequency of operation of the rotary valve disc 13 is reduced to further improve the endurance of the rotary valve.

Also, for example, in the cooling system corresponding to the second embodiment or the third embodiment, the downstream side of the rotary valve disc in the first passage portion may not branch off to the cylinder block and the cylinder head of the engine, like the cooling system corresponding to the first embodiment.

DESCRIPTION OF LETTERS OR NUMERALS

| | |
|---|---|
| W/P | 1 |
| engine | 2, 2' |
| radiator | 6 |
| cooling system | 1A, 1B, 1C |
| first passage portion | 11A, 11B |
| second passage portion | 12A, 12B, 12C |
| rotary valve disc | 13 |
| first thermostat | 17 |
| second thermostat | 18 |
| ECU | 30A, 30B, 30C |
| cooling circuit | 100A, 100B, 100C |

The invention claimed is:

1. An engine cooling system incorporated into an engine cooling circuit comprising a pump for circulating a coolant of an engine and a radiator for cooling the coolant of the engine, the engine cooling system comprising:

a rotary valve that comprises a first passage portion through which the coolant of the engine flows, and which is provided between the engine and a coolant outlet of the pump at a location downstream of the coolant outlet of the pump and upstream of the engine, relative to a single cooling cycle of the engine cooling system; a second passage portion through which the coolant of the engine flows, and which is provided between the radiator and a coolant inlet of the pump at a location downstream of the radiator and upstream of the coolant inlet of the pump, relative to the single cooling cycle of the engine cooling system; and a rotary valve disc interposed in the first and second passage portions, and being rotatable so as to simultaneously control the coolant flowing through the first passage portion and the coolant flowing through the second passage portion, the rotary valve being an electric motor driven type, and the engine cooling system further comprising a control portion controlling the rotary valve, the second passage portion communicating with the radiator at an upstream side of the rotary valve disc, and the rotary valve disc restricting a flow rate of the coolant flowing through the second passage from an upstream side to a downstream side of the rotary valve disc such that the rotary valve restricts a flow rate of the coolant flowing through the radiator, the rotary valve further comprising a first thermostat that opens when a temperature of the coolant of the engine is higher than a first predetermined value, the second passage portion communicating with the radiator through the first thermostat at the downstream side of the rotary valve disc, and the control portion controlling the rotary valve to restrict the flow rate of the coolant flowing through the second passage portion from the upstream side to the downstream side of the rotary valve disc, when the temperature of the coolant of the engine is significantly lower than the first predetermined value, the rotary valve further comprising a second thermostat that opens when the temperature of the coolant of the engine is higher than a second predetermined value, the second passage portion communicating with the radiator through the second thermostat at the upstream side of the rotary valve disc, and the second predetermined value being set lower than the first predetermined value.

2. The engine cooling system of claim 1, wherein the first passage portion branches off to an engine bypass path bypassing the engine at an upstream side of the rotary valve disc, and the rotary valve causes the coolant to flow through the engine bypass path, when the rotary valve disc portion restricts the coolant from flowing through the first passage portion.

3. The engine cooling system of claim 1, wherein the first passage branches off to a cylinder block and a cylinder head of the engine at a downstream of the rotary valve disc, and the rotary valve disc portion restricts the coolant from flowing through the first passage portion to the cylinder block and releases restriction of the coolant flowing to the cylinder head such that the rotary valve causes the coolant to preferentially flow to the cylinder head, selected from the cylinder block and the cylinder head.

4. The engine cooling system of claim 1, further comprising:

a valve bypass passage portion communicating with a downstream portion and an upstream side portion of the rotary valve disc; and a bypass valve mechanically interlocked with the first thermostat to restrict the coolant from flowing through the valve bypass passage portion with the first thermostat closed, and the bypass valve releasing restriction of the coolant flowing through the valve bypass passage portion with the first thermostat opened.

5. The engine cooling system of claim 4, wherein the bypass valve restricts or releases the coolant flowing through the valve bypass passage portion in response to a difference between a coolant pressure at the upstream side of the rotary valve disc and a coolant pressure at the downstream side of the rotary valve disc.

6. The engine cooling system of claim 1, further comprising a detection portion detecting or estimating a phase of the rotary valve disc.

* * * * *